US012253075B2

(12) United States Patent
Boguslawski et al.

(10) Patent No.: US 12,253,075 B2
(45) Date of Patent: Mar. 18, 2025

(54) DETECTING EVENTS IN PROGRESSING CAVITY PUMP OPERATION AND MAINTENANCE BASED ON ANOMALY AND DRIFT DETECTION

(71) Applicant: Schneider Electric Systems USA, Inc., Foxborough, MA (US)

(72) Inventors: Bartosz Boguslawski, Grenoble (FR); Loryne Bissuel-Beauvais, Montréal (CA); Matthieu Boujonnier, Boston, MA (US)

(73) Assignee: Schneider Electric Systems USA, Inc., Foxborough, MA (US)

( * ) Notice: Subject to any disclaimer, the term of this patent is extended or adjusted under 35 U.S.C. 154(b) by 451 days.

(21) Appl. No.: 17/564,095

(22) Filed: Dec. 28, 2021

(65) Prior Publication Data

US 2023/0272792 A1 Aug. 31, 2023

(51) Int. Cl.

| | |
|---|---|
| ***F04B 49/06*** | (2006.01) |
| ***E21B 47/008*** | (2012.01) |
| ***F04B 47/00*** | (2006.01) |
| ***F04B 49/10*** | (2006.01) |

(52) U.S. Cl.

CPC ..... *F04B 49/065* (2013.01); *E21B 47/008* (2020.05); *F04B 47/00* (2013.01); *F04B 49/103* (2013.01); *F04B 2203/0209* (2013.01); *F04B 2207/70* (2013.01)

(58) Field of Classification Search

CPC ..... F04B 47/00; F04B 49/065; F04B 49/103; F04B 2203/0209; F04B 2207/70; E21B 47/008

See application file for complete search history.

(56) References Cited

U.S. PATENT DOCUMENTS

| | | | | |
|---|---|---|---|---|
| 2019/0378210 | A1* | 12/2019 | Merrill | G06N 5/01 |
| 2020/0082296 | A1* | 3/2020 | Fly | G06N 7/01 |
| 2020/0240248 | A1* | 7/2020 | Abdeldaim | F04C 2/123 |
| 2021/0406288 | A1* | 12/2021 | Wright | G06N 20/00 |

* cited by examiner

*Primary Examiner* — Connor J Tremarche

(74) *Attorney, Agent, or Firm* — Troutman Pepper Locke LLP

(57) ABSTRACT

Systems/methods for real-time monitoring and control of a well site provide an event monitor and detector for progressing cavity pump (PCP) operations at the well site. The event monitor and detector uses machine learning (ML) based anomaly detection to detect operations that fall outside normal PCP operating space. The event monitor and detector then computes novelty scores for the anomalies and checks whether the novelty scores exceed a threshold novelty score. If the number of novelties detected within a given detection window exceeds a minimum threshold count, then the event monitor and detector flags an "event" and automatically responds accordingly. The event monitor and detector also provides an explanation with the alerts that quantifies the extent to which various PCP parameters contributed to the event. The event monitor and detector further performs drift detection to determine whether an event may be due to operator-initiated adjustments to PCP parameters.

20 Claims, 11 Drawing Sheets

DETECTING EVENTS IN PROGRESSING CAVITY PUMP OPERATION AND MAINTENANCE BASED ON ANOMALY AND DRIFT DETECTION

TECHNICAL FIELD

The present disclosure relates to monitoring oil and gas wells to ensure proper operation of the wells and more particularly to methods and systems for real-time monitoring and controlling of progressing cavity pump (PCP) operations using machine learning (ML) based anomaly (or novelty) and drift detection to detect abnormal pump operations and provide explanations therefor.

BACKGROUND

Oil and gas wells are commonly used to extract hydrocarbons from a subterranean formation. A typical well site includes a wellbore that has been drilled into the formation and sections of pipe or casing cemented in place within the wellbore to stabilize and protect the wellbore. The casing is perforated at a certain target depth in the wellbore to allow oil, gas, and other fluids to flow from the formation into the casing. Tubing is run down the casing to provide a conduit for the oil and gas to flow up to the surface where they are collected. The oil and gas can flow up the tubing naturally if there is sufficient pressure in the formation, but typically pumping equipment is needed at the well site to bring the fluids to the surface. One type of pump known as progressive cavity pumps (PCP) are particularly well adapted for a range of challenging artificial lift situations.

Oil and gas wells often operate unattended for extended intervals due to their location in remote areas. During these intervals, numerous environmental and other factors can affect operation of the wells. When problems arise, field personnel are typically required to travel to the well site, physically inspect the equipment, and make any needed repairs. This can be a costly and time-consuming endeavor, resulting in loss productivity and profitability for well owners and operators, and can also be dangerous for the field personnel.

Thus, while a number of advances have been made in the field of oil and gas production, it will be readily appreciated that improvements are continually needed.

SUMMARY

The present disclosure relates to systems and methods for real-time monitoring and control of well operations at a well site. The methods and systems provide an event detector that monitors and controls progressing cavity pump (PCP) operations at the well site. The event detector uses ML-based anomaly detection to detect operations that fall outside normal PCP operation. The event detector computes novelty scores for the anomalies and checks whether the novelty scores exceed a threshold novelty score. The threshold novelty score indicates whether an anomaly falls far enough outside normal PCP operational space to be considered a "novelty." If the number of novelties that the event detector detects within a given detection window exceeds a minimum threshold count, then the event detector flags an "event" and automatically responds accordingly. The response includes issuing one or more alerts to notify well operators that abnormal PCP operations have been detected. The event detector also provides an explanation with the alerts that identifies operational parameters that contributed to the abnormal operations and quantifies the contribution by each parameter. This feature allows operators the option to ignore abnormal operations that are caused primarily by non-actionable or less actionable parameters. The event detector can also take predefined corrective actions to reduce potential damage to the PCP as part of the automatic response in some embodiments.

In some embodiments, the event detector also uses ML-based drift detection to determine whether an event may be a result of operator adjustments or modifications to PCP parameters as opposed to abnormal operations. The drift detection helps identify PCP behavior that potentially reflects new normal operational behavior and not abnormal operation. When a drift is detected in conjunction with detection of an event, the event detector issues a drift notification containing drift information along with the event alert. The drift information may include, for example, which parameter values changed due to drift and the amount of the change. The event detector is then retrained to detect anomalies based on the adjusted or modified PCP parameters reflecting the potentially new normal behavior.

Other features and benefits of the event detector include a reduction in sensitivity to routine pump speed changes and an ability to fine tune event detections specifically for each well site. Overall, the event detector disclosed herein can help decrease downtime and minimize lost productivity and cost as well as reduce health and safety risks for field personnel.

In general, in one aspect, the present disclosure relates to a system for monitoring a progressing cavity pump (PCP) at a well site. The system comprises, among other things, a processor and a storage device coupled to the processor, the storage device storing computer-readable instructions thereon for an event monitor and detector. The event monitor and detector, when executed by the processor, causes the processor to sample data relating to operation of the PCP at the well site, the data representing parameters that affect PCP operation at the well site. The event monitor and detector, when executed by the processor, also causes the processor to convert each set of sampled data to a data point, except for sampled data indicating that the PCP was non-operational. The event monitor and detector, when executed by the processor, further causes the processor to compute a novelty score for each data point that falls outside a normal operating space for the PCP, the novelty score indicating a distance between the data point and the normal operating space. The event monitor and detector, when executed by the processor, still further causes the processor to obtain a count of data points that have a novelty score that exceeds a threshold novelty score within a rolling detection window. The event monitor and detector, when executed by the processor, still further causes the processor to initiate a responsive action in response to the count exceeding an event threshold count, the responsive action including at least one of: issuing an alert message to a control system notifying that an event has occurred, logging a date and time for the event, adjusting a motor speed of the PCP, or shutting off power to the PCP.

In general, in another aspect, the present disclosure relates to a method of monitoring a progressing cavity pump (PCP) at a well site. The method comprises, among other things, sampling, by an event monitor and detector, data relating to operation of the PCP at the well site, the data representing parameters that affect PCP operation at the well site. The method also comprises converting, by the event monitor and detector, each set of sampled data to a data point, except for sampled data indicating that the PCP was non-operational, and computing, by the event monitor and detector, a novelty score for each data point that falls outside a normal operating space for the PCP, the novelty score indicating a distance between the data point and the normal operating space. The method further comprises detecting, by the event monitor and detector, a count of data points that have a novelty score that exceeds a threshold novelty score within a rolling detection window, and initiating, by the event monitor and detector, a responsive action in response to the count exceeding an event threshold count. The responsive action includes at least one of: issuing an alert message to a control system notifying that an event has occurred, logging a date and time for the event, adjusting a motor speed of the PCP, or shutting off power to the PCP.

In general, in yet another aspect, the present disclosure relates to a computer-readable medium comprising computer-readable instructions for causing a computer to, among other things, sample data relating to operation of a PCP at a well site, the data representing parameters that affect PCP operation at the well site. The computer-readable instructions also cause the computer to convert each set of sampled data to a data point, except for sampled data indicating that the PCP was non-operational, and compute a novelty score for each data point that falls outside a normal operating space for the PCP, the novelty score indicating a distance between the data point and the normal operating space. The computer-readable instructions further cause the computer to obtain a count of data points that have a novelty score that exceeds a threshold novelty score within a rolling detection window, and initiate a responsive action in response to the count exceeding an event threshold count. The responsive action includes at least one of: issuing an alert message to a control system notifying that an event has occurred, logging a date and time for the event, adjusting a motor speed of the PCP, or shutting off power to the PCP.

BRIEF DESCRIPTION OF THE DRAWINGS

A more detailed description of the disclosure, briefly summarized above, may be obtained by reference to various embodiments, some of which are illustrated in the appended drawings. While the appended drawings illustrate select embodiments of this disclosure, these drawings are not to be considered limiting of its scope, for the disclosure may admit to other equally effective embodiments.

Identical reference numerals have been used, where possible, to designate identical elements that are common to the figures. However, elements disclosed in one embodiment may be beneficially utilized on other embodiments without specific recitation.

DETAILED DESCRIPTION

This description and the accompanying drawings illustrate exemplary embodiments of the present disclosure and should not be taken as limiting, with the claims defining the scope of the present disclosure, including equivalents. Various mechanical, compositional, structural, electrical, and operational changes may be made without departing from the scope of this description and the claims, including equivalents. In some instances, well-known structures and techniques have not been shown or described in detail so as not to obscure the disclosure. Furthermore, elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is noted that, as used in this specification and the appended claims, the singular forms "a," "an," and "the," and any singular use of any word, include plural references unless expressly and unequivocally limited to one reference. As used herein, the term "includes" and its grammatical variants are intended to be non-limiting, such that recitation of items in a list is not to the exclusion of other like items that can be substituted or added to the listed items.

Figure 1:
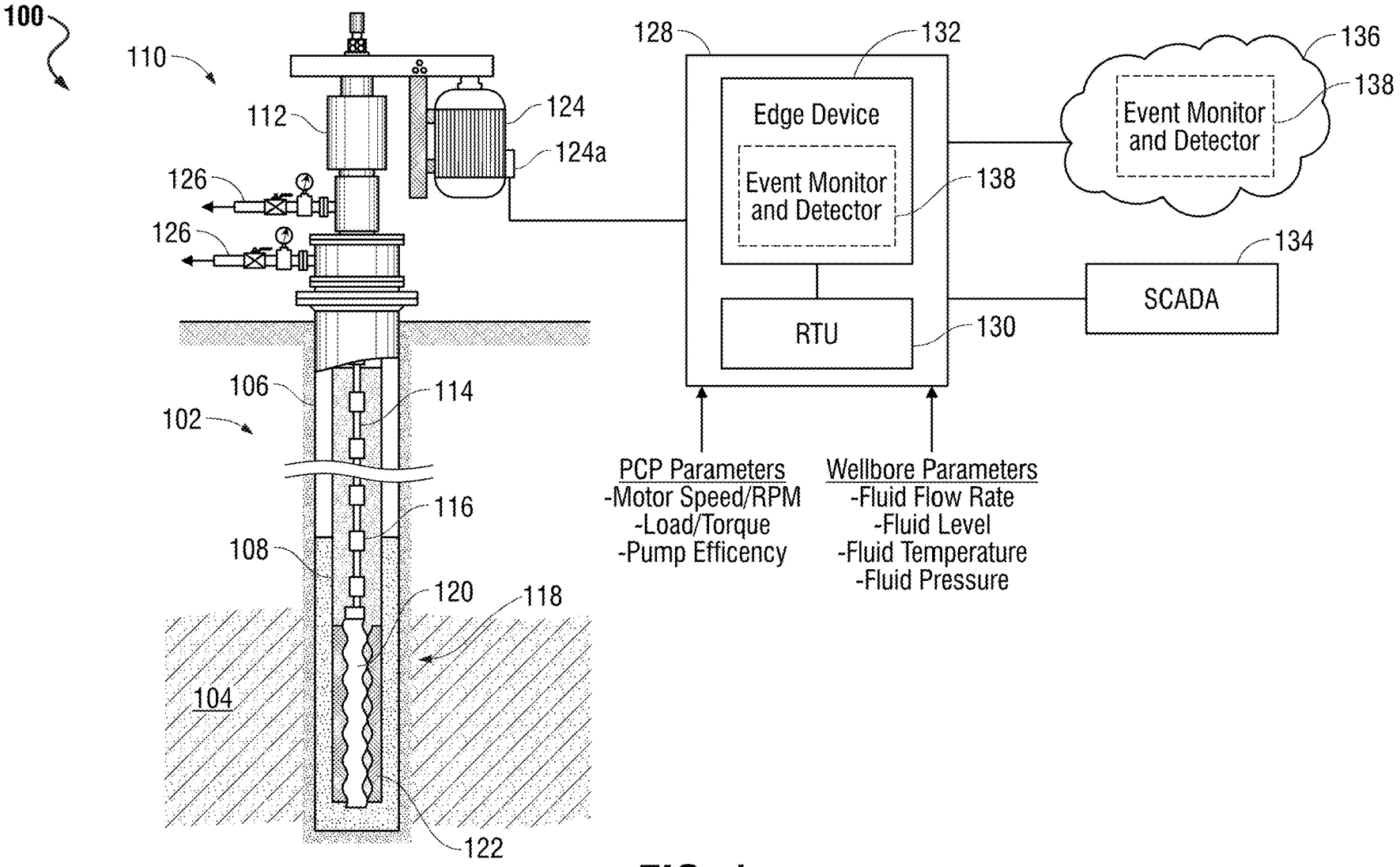
FIG. 1 illustrates an exemplary well site deployment of an event monitor and detector according to embodiments of the present disclosure.

Referring now to FIG. 1, a schematic diagram is shown for an exemplary well site 100 having fault monitoring and detection capability according to embodiments of the present disclosure. As can be seen, a wellbore 102 has been drilled into a subterranean formation 104 at the well site 100. Casing 106 has been cemented into the wellbore 102 and production tubing 108 has been extended down the casing 106 for bringing up oil and other hydrocarbons. The formation 104 in this example no longer has sufficient formation pressure to produce the hydrocarbons naturally and therefore artificial lift is provided via a progressing cavity pump (PCP) 110.

Operation of the PCP 110 is well known to those skilled in the art and thus a detailed description is omitted here for economy. The PCP 110 typically includes a wellhead drive 112, a rod string 114 made of individual rod segments connected by couplings 116, and a pump assembly 118 attached to the end of the rod string 114. The pump assembly 118 is composed of an elongated helical rotor 120 sealingly engaged within a stator 122 and driven (rotated) by a variable speed drive (VSD) 124 located at the surface. The oil and other hydrocarbons brought up by the PCP 110 from the wellbore 102 are then carried away by one or more flow lines 126 for processing.

A control unit 128 at the well site 100 gathers data about various aspects of PCP operation at the well site 100 for monitoring and control purposes. The control unit 128 includes a remote terminal unit (RTU) 130 (also called remote telemetry unit) that receives data relating to operation of the PCP 110. The data represents operational parameters that affect or are affected by operation of the PCP at the well site, including PCP parameters and wellbore parameters. PCP parameters may include motor speed (rpm), load (torque), pump efficiency, and other parameters that directly affect operation of the PCP 110. Motor speed and load are typically measured by a controller 124*a* in the VSD 124, while pump efficiency is typically calculated by the controller 124*a*. The VSD controller 124*a* provides these parameters (or measurement data therefor) either continuously or at regularly scheduled intervals in real time to the RTU 130. Wellbore parameters may include, for example, flow rate and fluid pressure of the fluids flowing through the flow lines 126, fluid levels and temperatures down the wellbore 102, and the like. The RTU 130 receives these wellbore parameters (or measurement data therefor) from wireless and wired field sensors (not expressly shown) installed at locations around the well site 100.

An edge device 132 in the control unit 128 provides a network access or entry point for the RTU 130 to communicate the collected data to a downstream control system 134, such as a supervisory control and data acquisition (SCADA) system, as well as an internal and/or external network environment 128, including a cloud computing environment. The edge device 132 allows the RTU 130 to transmit and receive data to and from the control system 134 and the network environment 136 as needed over a communication link (e.g., Ethernet, Wi-Fi, Bluetooth, GPRS, CDMA, etc.). Any type of edge device or appliance may be used as the edge device 132, provided the device has sufficient processing capacity for the purposes discussed herein. Examples of suitable edge devices include gateways, routers, routing switches, integrated access devices (IADs), and various MAN and WAN access devices.

In accordance with embodiments of the present disclosure, the edge device 132 is provided with an event monitor and detector 138 that monitors operation of the PCP 110 at the well site 100. The event monitor and detector 138 can be deployed directly on the edge device 132 to receive the operational parameters from the RTU 130 in real time, as shown. Alternatively, a portion or all of the event monitor and detector 138 can be deployed on the networked environment 136, such as a public or private (i.e., enterprise) cloud computing environment. In the latter case, the operational parameters received from the RTU 130 can be transmitted by the edge device 132 to the event monitor and detector 138 running on the networked environment 136 either continuously or on a regular basis.

Once deployed, the event monitor and detector 138 can help decrease downtime and minimize lost productivity and cost as well as increase the efficiency and effectiveness of well operators. The event monitor and detector 138 can achieve this by using machine learning (ML) based models to detect anomalies in PCP operation. The event monitor and detector 138 can then determine whether the anomaly falls far enough outside normal PCP operation to be considered a "novelty." The term "novelty" for purposes herein refers to any measurement data that is significantly different from measurement data previously acquired during known normal operation, as found in a training data set, for example.

Figure 2:
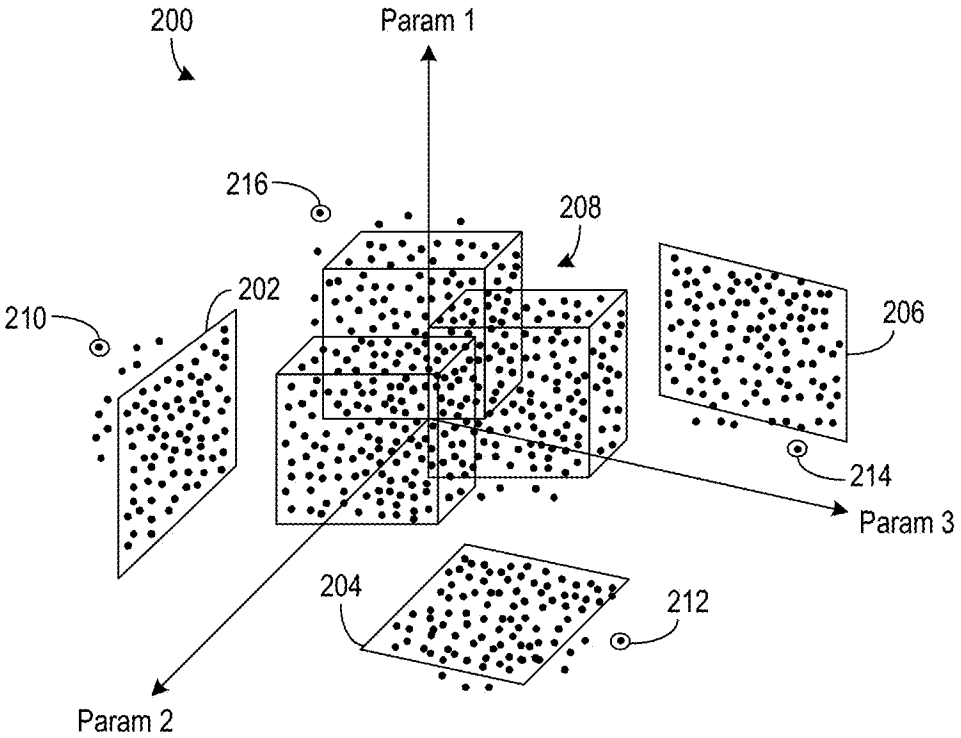
FIG. 2 illustrates an exemplary normal operating space for an event monitor and detector according to embodiments of the present disclosure.

FIG. 2 is a plot 200 illustrating exemplary normal PCP operation in the context of the event monitor and detector 138. The plot 200 has three axes that are orthogonal to one another, each axis corresponding to an operational parameter: Parameter 1 (e.g., motor speed), Parameter 2 (e.g., motor load), and Parameter 3 (e.g., fluid level). Note that three parameters are used in the plot 200 for ease of illustration only. Those having ordinary skill in the art will appreciate that fewer or more than three parameters may be used to represent operation of the PCP 110 within the scope of the present disclosure.

Measurement data for each Parameter 1, 2, 3 over a given time interval (e.g., 5 months) are plotted on a plane intersecting the axis for that parameter. The measurement data in this example were obtained from preprocessed training data and thus mostly reflect known normal PCP operation. Assume for illustrative purposes that this normal measurement data for any two parameters roughly covers an area having the shape of a square, although other shapes, such an elliptic shape, or functions may be used to approximate the normal measurement data. Area 202 thus contains normal measurement data for Parameters 1 and 2, area 204 contains normal measurement data for Parameters 2 and 3, and area 206 contains normal measurement data for Parameters 1 and 3. Any measurement data for Parameters 1, 2, or 3 that fall outside areas 202, 204, or 206, respectively, is considered to be an anomaly for that respective parameter.

Each set of measurements for the three parameters may then be consolidated, combined, or otherwise converted to a single data point for processing by the event monitor and detector 138 in some embodiments. This conversion can be done in some embodiments simply by letting the data point be the point defined by the values of the Parameters 1, 2, and 3, as follows:

Data Point $P_i$=P (Parameter$_i$ 1, Parameter$_i$ 2, Parameter$_i$ 3)

where i represents a step in a time series. Other ways of converting the measurements for Parameters 1, 2, and 3 into a single data point may also be used within the scope of the present disclosure. The resulting data points may then be plotted in the plot 200 as shown, where volume 208 contains the data points that reflect normal PCP operation, or normal operating space. It should be noted that the normal operating space 208 is depicted here as overlapping cubes for illustrative purposes only. As mentioned, other shapes or functions may be used to approximate the normal operating space 208. In addition, more than three parameters may be used to define the normal operating space 208 in some embodiments, in which case the normal operating space 208 may resemble a hypercube or other n-dimensional shape or function where n is greater than 3.

In FIG. 2, any data points falling outside the normal operating space 208 is considered to be an anomaly with respect to the three parameters. But as touched upon above, not all anomalies are "novelties." Only when an anomaly falls sufficiently far outside normal PCP operating space is the anomaly considered to be a "novelty." To this end, the event monitor and detector 138 computes a novelty score for each anomaly in some embodiments. The novelty score may simply be a straight-line distance (i.e., Euclidean distance) from an anomaly to the normal PCP operating space 208 in some embodiments.

The event monitor and detector 138 then checks whether the novelty score for any data points exceeds a predefined threshold novelty score. This ensures only anomalies that are far enough outside normal PCP operating space 208 are considered by the event monitor and detector 138 be a "novelty." An example of a threshold novelty score that may be used by the event monitor and detector 138 is 0.12 (which is a unitless quantity). In the FIG. 2 example, data point 216 is considered to be a novelty with respect to the normal operating space 208. Similarly, measurement 210 is considered a novelty for Parameter 1, measurement 212 is considered a novelty for Parameter 2, and measurement 214 is considered a novelty for Parameter 3. The threshold novelty score may be adjusted from time to time as needed for a particular implementation.

In addition to the threshold novelty score, the event monitor and detector 138 also looks at the number of novelties detected within a given window of time. In some embodiments, if the number of novelties detected within a given time window exceeds a minimum threshold count, then that constitutes an "event." An "event" for purposes herein is an aggregation of novelties with a sufficient density in a specific time range. The detection window may be a rolling window having any suitable duration, such as 4 hours, depending on the particular application.

Upon detecting an event, the event monitor and detector 138 automatically responds by performing one or more predefined actions. These actions may include issuing one or more alerts to notify well operators that the PCP is operating abnormally, reducing PCP motor speed, and/or shutting off power to the PCP to reduce potential damage. In some embodiments, the event monitor and detector 138 takes certain types of actions, such as cutting power to the PCP 110, only when a preselected minimum number of events is detected within a given event window (which may coincide with the detection window). In either case, the use of novelties and events as described herein to detect abnormal operations ensures that only alerts that have a high confidence value are sent to well operators and/or presented on a display of the edge device 132.

Figure 3:
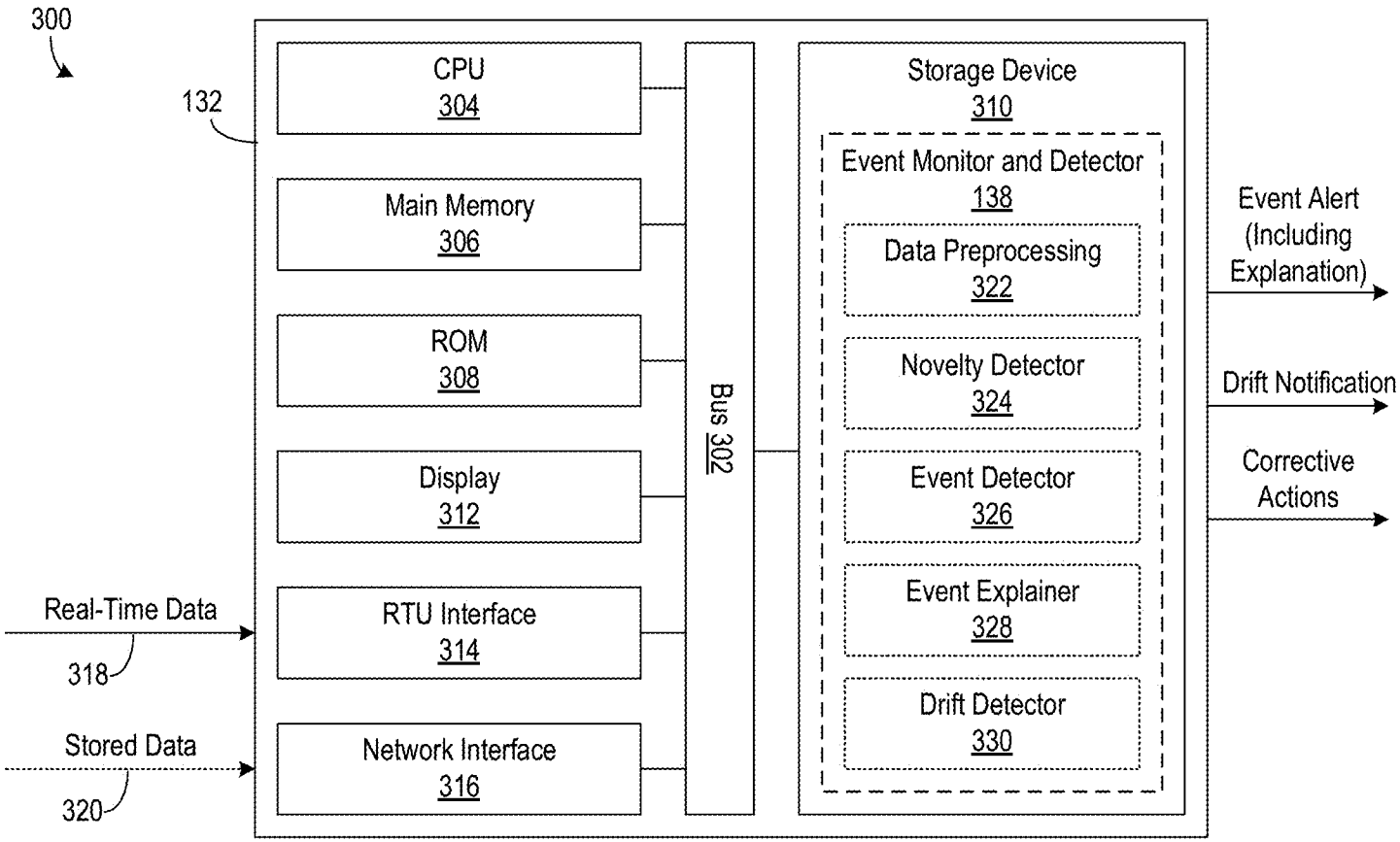
FIG. 3 illustrates an exemplary implementation of an event monitor and detector on an edge device according to embodiments of the present disclosure.

FIG. 3 is a block diagram 300 illustrating an exemplary deployment of the event monitor and detector 138 on the edge device 132 in accordance with embodiments of the present disclosure. The edge device 132 may be a gateway device in some embodiments. In one embodiment, the edge device 132 includes a bus 302 or other communication pathway for transferring information within the gateway, and a CPU 304, such as an Intel microprocessor, coupled with the bus 302 for processing the information. The edge device 132 may also include a main memory 306, such as a random-access memory (RAM) or other dynamic storage device coupled to the bus 302 for storing computer-readable instructions to be executed by the CPU 304. The main memory 306 may also be used for storing temporary variables or other intermediate information during execution of the instructions executed by the CPU 304.

The edge device 132 may further include a read-only memory (ROM) 308 or other static storage device coupled to the bus 302 for storing static information and instructions for the CPU 304. A computer-readable storage device 310, such as a nonvolatile memory (e.g., Flash memory) drive or magnetic disk, may be coupled to the bus 302 for storing information and instructions for the CPU 304. The CPU 304 may also be coupled via the bus 302 to a display 312, which may be a touchscreen interface, for displaying alerts and other information to a user and allowing the user to interact with the edge device 132 and the RTU 130. An RTU interface 314 may be coupled to the bus 302 for allowing the RTU 130 to communicate with the edge device 132. A network or communications interface 316 may be provided for allowing the edge device 132 to communicate with the external system, such as the SCADA system 134 and/or the network 136.

The term "computer-readable instructions" as used above refers to any instructions that may be performed by the CPU 304 and/or other components. Similarly, the term "computer-readable medium" refers to any storage medium that may be used to store the computer-readable instructions. Such a medium may take many forms, including, but not limited to, non-volatile media, volatile media, and transmission media. Non-volatile media may include, for example, optical or magnetic disks, such as the storage device 310. Volatile media may include dynamic memory, such as main memory 306. Transmission media may include coaxial cables, copper wire and fiber optics, including wires of the bus 302. Transmission itself may take the form of electromagnetic, acoustic or light waves, such as those generated during radio frequency (RF) and infrared (IR) data communications. Common forms of computer-readable media may include, for example, magnetic medium, optical medium, memory chip, and any other medium from which a computer can read.

An event monitor and detector 138, or rather the computer-readable instructions therefor, may also reside on or be downloaded to the storage device 310. In some embodiments, the storage device 310 may be an eMMC (Embedded Multimedia Card) storage device, and the event monitor and detector 138 may run on a Docker container on top of a Linux operating system installed on the eMMC. The event monitor and detector 138 has several modules that provide the fault monitoring and detection functionality discussed above, including a data preprocessing module 322, a novelty detector module 324, an event detector 326, a novelty explainer module 328, and a drift detector module 330. Such an event monitor and detector 138 may then be executed by the CPU 304 and/or other components of the edge device 132 to perform ML-based detection of abnormal PCP operation and automatically generate a response thereto. The event monitor and detector 138 may be written in any suitable computer programming language known to those skilled in the art using any suitable software development environment known. Examples of suitable programming languages may include C, C++, C#, Python, Java, Perl, and the like.

The data preprocessing module 322, as the name suggests, performs preprocessing of the operational parameters mentioned above, or the measurements thereof, from the RTU 130. The data provided to the data preprocessing module 322 is typically real-time operational data (solid arrow 318) received at the RTU 130, but it is also possible for the event monitor and detector 138 to operate using previously stored data (dotted arrow 320) from a repository or database, or a combination of real-time and stored data. The data preprocessing module 322 then operates to resample and consolidate, combine, and otherwise convert the data for the various operational parameters to single data points.

The novelty detector module 324 operates to receive preprocessed data from the data preprocessing module 322 and process the data to detect novelties from any anomalies in the data. To this end, the novelty detector module 324 runs a novelty detection algorithm that determines whether a data point is outside normal PCP operating space 208 and is therefore an anomaly. If a data point is determined to be an anomaly, then the novelty detector module 324 computes a novelty score for the anomalous data point and compares the novelty score to a threshold novelty score. The threshold novelty score ensures that only anomalies that are far enough outside the normal PCP operating space 208 are considered to be a "novelty." As mentioned, the novelty score may be a straight-line distance from the anomalous data point to the normal PCP operating space 208 in some embodiments.

The event detector module 326 operates to determine whether the number of novelties detected within a given window of time rises to the level of an "event." In some embodiments, if the number of novelties detected within a given time window exceeds a minimum event threshold count, then the event detector module 326 logs that an "event" has occurred. The event threshold count may be set to 9 in some embodiments, while the detection window may be a rolling 4-hour window in some embodiments. If an event is detected, then the event detector module 326 automatically responds to the event. The response can include issuing one or more alerts to the control system 134 to notify well operators that abnormal PCP operations have been detected. The response can also include automatically taking certain predefined corrective actions via the RTU 130, such as reducing motor speed, or cutting off power, to minimize potential damage to the PCP.

The event explainer module 328 operates to provide an explanation for the events that are detected by the event detector module 326. For a given event, the explanation identifies the operational parameters that contributed to the occurrence of the event and quantifies the extent of the contribution by each parameter. The event explainer module 328 then notifies operators by providing the explanation to the control system 134 (e.g., SCADA system). In some embodiments, the event explainer module 328 uses SHAP (SHapley Additive explanations) to quantify the extent to which each parameter contributed to the event. SHAP is well known in the art as an efficient way to interpret ML model predictions through the use of Shapely values. Shapley values are a way to attribute how much each feature played a role in a model's prediction. SHAP provides a more efficient way to derive Shapley values compared to the original approach developed by Lloyd Shapley.

Finally, the drift detector module 330 operates to determine whether a given event may have occurred in conjunction with operator-initiated parameter adjustments or modifications and is therefore a reflection of a new normal operating space and not necessarily abnormal PCP operation. If the drift detector module 330 detects that the event occurred in conjunction with a drift, then it issues a drift notification containing drift information via the control system 134 to let operators know that the event may not be an indication of abnormal PCP operation. The drift information may include, for example, which parameters reflect changes that were due to drift and the amount of change. The drift detector module 330 may use one or more techniques for detecting the drift, as described further herein, including looking at minimum/maximum values, minimum/maximum values plus a percentage, and individual variable (or parameter) values.

Before any detection can be performed, the event detector module 326, event explainer module 328, and drift detector module 330 should be appropriately trained so they can perform their respective functions within the event monitor and detector 138. Training involves inputting a training data set into one or more ML models that are used to make the various detections mentioned above. The ML model training may use a semi-supervised learning method in some embodiments in which data representing periods of abnormal operation has been removed. The ML model or models are then trained using the remaining normal operation data and the normal operation space is estimated based on this normal training data. The training may be done on the cloud computing environment 136 in some embodiments.

Figure 4:
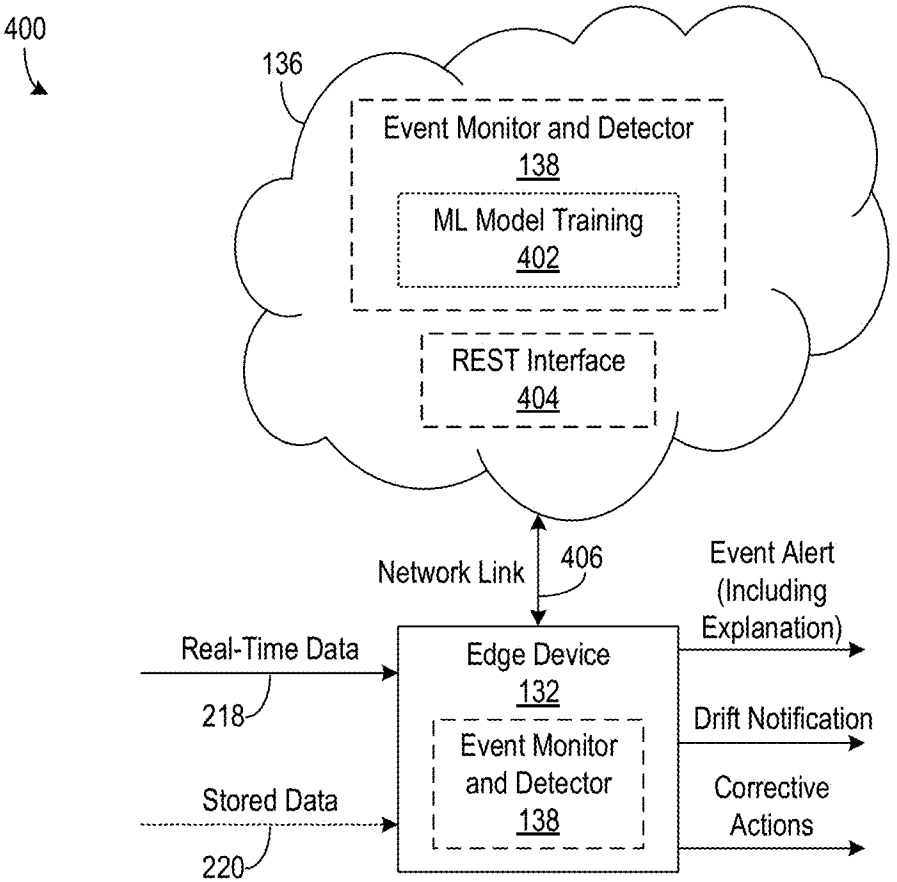
FIG. 4 illustrates an exemplary implementation of an event monitor and detector on a network for ML training according to embodiments of the present disclosure.

FIG. 4 is a block diagram 400 illustrating an exemplary deployment that can facilitate training of the various ML models used with the event monitor and detector 138. In this example, the event monitor and detector 138 resides on the edge device 132 and operates as discussed above, but additionally includes an ML model training module 402 that resides on the cloud computing environment 136. The ML model training module 402 can then be used to train the various ML models used with the event monitor and detector 138. An application programming interface (API) 404, such as a REST (REpresentational State Transfer) interface, may be called to transfer data between the event monitor and detector 138 on the edge device 132 and the portion thereof residing on the cloud computing environment 136. Operational data (e.g., real-time data 318 and/or stored data 320) may then be sent from the edge device 132 via the REST interface 404 to the cloud computing environment 136 over a network link 406 for training and any other purposes. In some embodiments, the edge device 132 forms part of an IoT (Internet of Things) infrastructure and communication between the edge device 132 and the computing environment 136 is managed by IoT software installed on the edge device 132 instead of through a REST API.

The ML model training module 402, in general, and as discussed further herein (see FIG. 6), can be used to facilitate training of the ML models in the event monitor and detector 138. For example, the ML model training module 402 can be used to input training data representing expected or normal operational behavior into the ML models to train the models based on the training data. The process of training an ML model involves providing an ML algorithm (i.e., the learning algorithm) with training data from which the model can learn. Several types of ML algorithms known to those having ordinary skill in the art may be used to train the ML models, including supervised, unsupervised, semi-supervised, self-supervised, and reinforcement learning algorithms. Examples of suitable ML algorithms include support vector machine (SVM), Local Outlier Factor (LOF), Kernel principal component analysis (kPCA), neural networks, clustering, and K-nearest neighbor (KNN), among others. The training data may be derived as shown in FIG. 5 in some embodiments.

Figure 5:
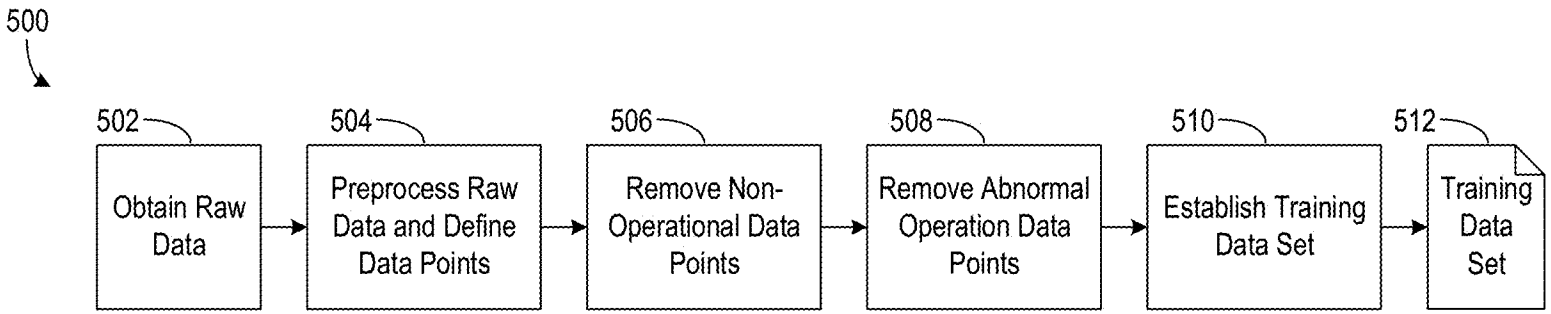
FIG. 5 illustrates an exemplary method of preparing a training data set for an event monitor and detector according to embodiments of the present disclosure.

Referring to FIG. 5, a flow diagram 500 illustrates an exemplary method that may be used to derive a training data set. The method may be used by or with the data preprocessing module 322 and the ML model training module 402 to prepare the training data set. The method generally begins at 502 where the data preprocessing module 322 acquires or is used to acquire a set of raw measurement data pertaining to operation of the PCP to be monitored (e.g., PCP 110). As discussed above, the raw measurement data may be measurements of motor speed, motor load, pump efficiency, flow rate, fluid pressure, fluid level, temperature, and the like. The raw measurement data should span a sufficiently long time interval, such as a month or more, to ensure that the data provides an accurate portrayal of the operational behavior of the PCP for model training purposes.

At 504, the data preprocessing module 322 resamples or is used to resample the raw data using a preselected time step, such as every 5 minutes. This helps reduce the amount of duplicate or redundant data that has to be processed. Each set of resampled data will have the same timestamp (i.e., every 5 minutes) and will be consolidated, combined, or otherwise converted to one data point. At 506, the data preprocessing module 322 removes or is used to remove any data points considered to be non-operational. For purposes herein, non-operational data points are data points where the motor speed is less than 20 rpm, for example. At 508, the preprocessed data is provided to the ML model training module 402 for removing any data points considered by the well operators (or outside subject matter experts) to constitute known abnormal PCP operation. At 510, the ML model training module 402 establishes or is used to establish the remaining data points as a training data set 512 (i.e., declares the remaining data points as the training data set).

Figure 6:
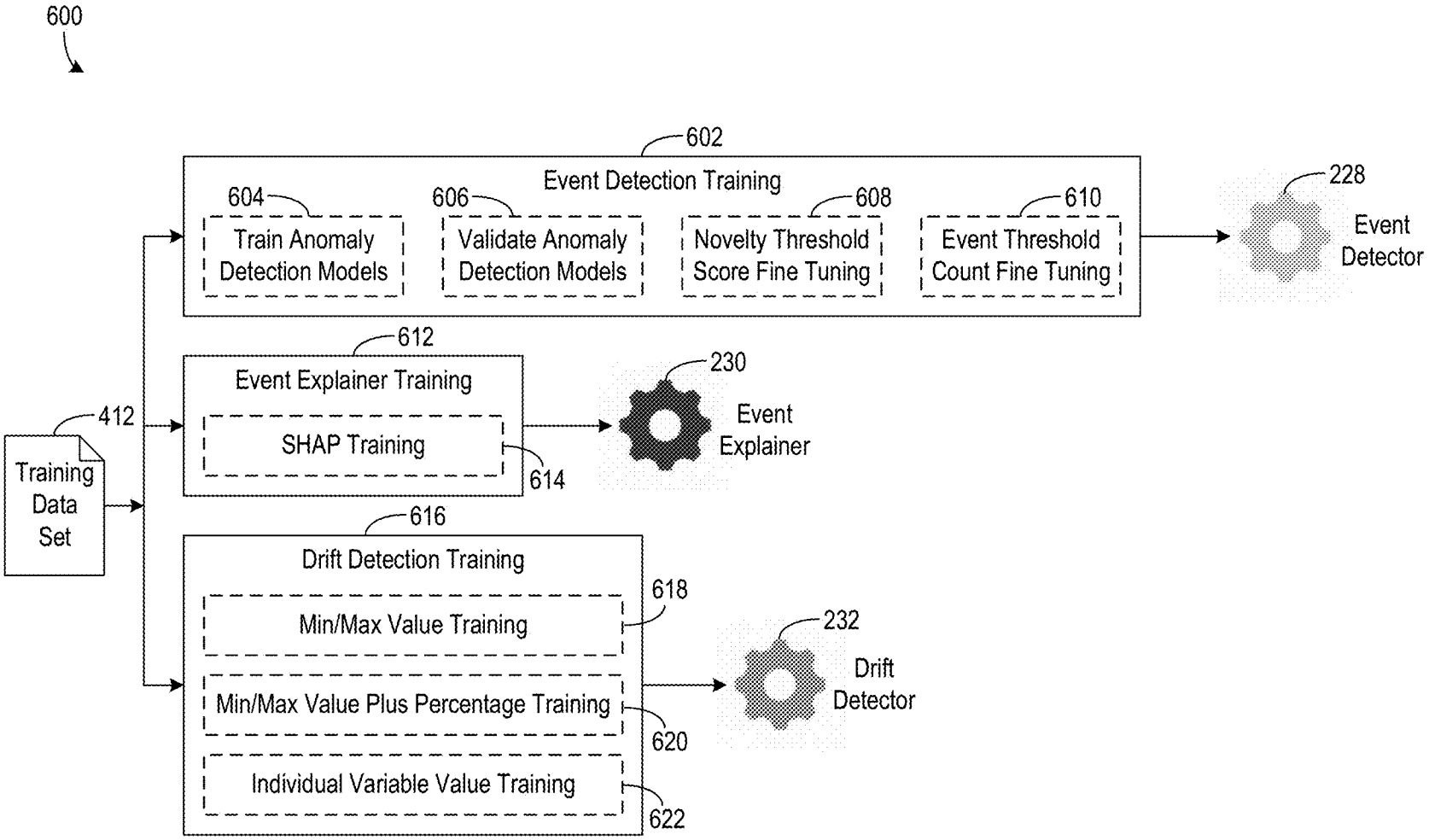
FIG. 6 illustrates an exemplary method of training an event monitor and detector according to embodiments of the present disclosure.

FIG. 6 is a flow diagram illustrating an exemplary method 600 that may be used by or with the ML model training module 402 to train any ML models used by the event monitor and detector 328, event explainer module 328, and drift detector module 330. As can be seen, event detection training generally occurs at 602 where one or more ML models are trained to detect anomalies in the measurement data at 604 using the training data set 512 (or selected portion thereof). At 606, validation data, which may be included in the training data set 512, is applied to the trained models to determine whether they can recognize anomalies with a sufficiently high degree of efficacy. During this stage of the training, the minimum threshold score required for an anomaly to be considered a novelty may also be fine-tuned at 608. Likewise, the minimum threshold count of novelties required for detection of an "event" may also be fine-tuned at 610. The thusly trained ML models may then be deployed for real-time operation as part of the event monitor and detector 328.

In a similar manner, event explainer training generally occurs at 612 where one or more ML models are trained to generate explanations for detected events. In some embodiments, the event explainer training includes using the training data set 512 (or selected portion thereof) to train the one or more ML models to generate SHAP values at 614. As mentioned, SHAP is well known in the art as an efficient way to interpret ML model predictions through the use of Shapely values. In particular, the ML models may be trained to use Kernel SHAP to generate SHAP values. Kernel SHAP is a highly efficient method that allows Shapley values to be calculated using significantly fewer coalition samples compared to the original approach developed by Lloyd Shapley. Other techniques besides SHAP may of course be used within the scope of the disclosed embodiments. The ML models thusly trained may then be deployed for real-time operation as part of the event explainer module 328.

Likewise, drift detection training generally occurs at 616 where one or more ML models are trained to detect drifts. The drift detection training includes using the training data set 512 (or selected portion thereof) to provide training for several drift detection techniques: minimum/maximum value 618, minimum/maximum value plus percentage 620, and individual variable (or parameter) value 622. In some embodiments, an ML model is used for each technique and each parameter (i.e., training 15 ML models for 5 parameters). Although three drift detection techniques are disclosed, those having ordinary skill in the art will understand it is not necessary to use all three of the techniques shown, and any one or more of these techniques may be used individually or in combination with one another to provide drift detection. As well, other techniques known to those skilled in the art for detecting drifts may be used within the scope of the disclosed embodiments. The thusly trained ML models may then be deployed for real-time operation as part of the drift detector module 330, as explained with respect to FIG. 7.

Figure 7:
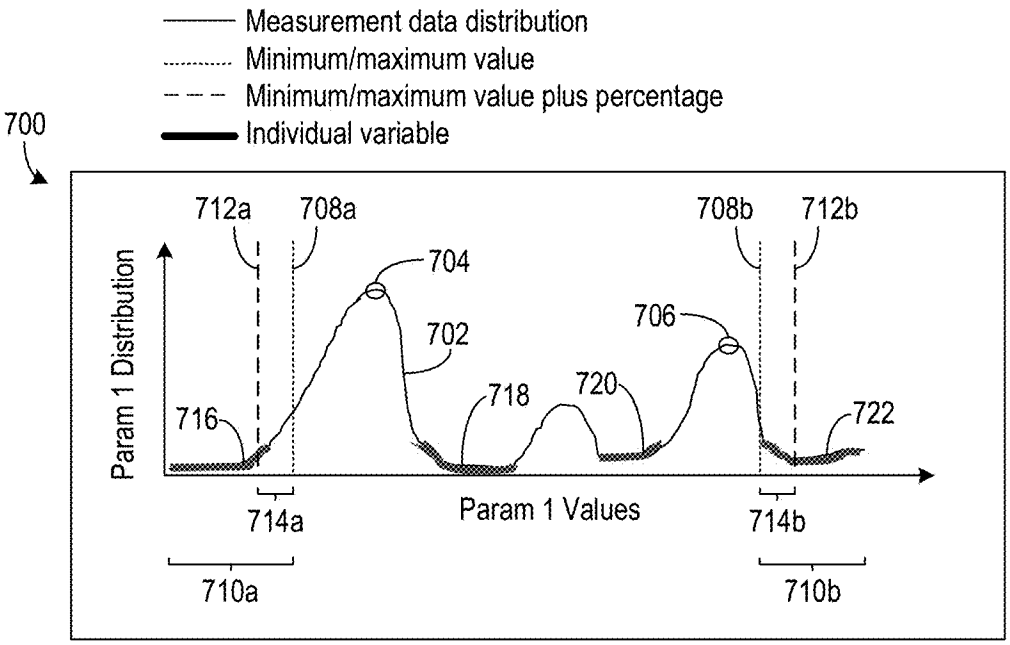
FIG. 7 illustrates an exemplary method of drift detection for an event monitor and detector according to embodiments of the present disclosure.

Referring to FIG. 7, a graph 700 illustrates drift detection based on a given PCP parameter, Parameter 1, which may be motor load, for example. In the graph 700, the horizontal axis represents parameter values as measured over a given time interval (e.g., 5 months) and the vertical axis represents the number of occurrences for each value over that time interval. Line 702 represents the distribution of Parameter 1 over the given time interval. As can be seen, most of the measurement values for Parameter 1 fall within one of two main regions, the peaks for which are indicated at 704 and 706. The distribution of other parameters may also be depicted using similar graphs.

It is important in FIG. 7 for the event monitor and detector 138 (via drift detector 330) to determine whether any of the measurement values for Parameter 1 were a result of operator-initiated modifications and adjustment, and thus represent a drift (i.e., normal albeit new behavior), or whether they indicate an anomaly. One way for the event monitor and detector 138 to detect drift (via drift detector 330) is by using the minimum/maximum value technique mentioned above. The event monitor and detector 138 looks at the minimum and the maximum measurement values in the training data for Parameter 1 and sets those values as the minimum and maximum boundaries for the measurement values of Parameter 1, as indicated by boundary lines 708*a* and 708*b*. For a given event, if the measurement values for Parameter 1 fall outside the minimum and maximum boundary lines 708*a* and 708*b*, as indicated at 710*a* and 710*b*, then the event monitor and detector 138 flags the event as potentially due to drift and not indicative of abnormal operation.

A second way for the event monitor and detector 138 to detect drift (via drift detector 330) is by using the minimum/maximum value plus a percentage technique referenced earlier. This technique limits the range of measurement values that may be attributed to drift to a minimum and maximum value plus a percentage, for example, 10 percent of the same boundary lines 708*a* and 708*b* that was used for the first technique, as indicated by percentage lines 712*a* and 712*b*. Other minimum/maximum values and/or percentages may of course be used. Thereafter, for a given event, if the measurement values for Parameter 1 fall within the percentage lines 712*a* and 712*b*, as indicated at 714*a* and 714*b*, then the event monitor and detector 138 records the event as possibly due to drift and not indicative of abnormal operation.

Another way for the event monitor and detector 138 to detect drift (via drift detector 330) is by using the individual variable (or parameter) value technique touched on above. As the name suggests, the individual variable value technique is applied by the event monitor and detector 138 on an individual parameter basis. The technique limits the measurement values that may be attributed to drift to only measurement values that exceed the novelty threshold score discussed in FIG. 2 (i.e., values that fall significantly outside the normal operating space for that parameter). For a given event, if the measurement values for Parameter 1 exceed the threshold novelty score, as indicated at 716, 718, 720, and 722, then the event monitor and detector 138 notes that the event may be due to drift and not necessarily indicative of abnormal operation. As can be seen, the individual variable value technique found measurement values (718 and 720) that would not have been attributed to drift using either the minimum/maximum value technique or the minimum/maximum value plus a percentage technique.

Figure 8:
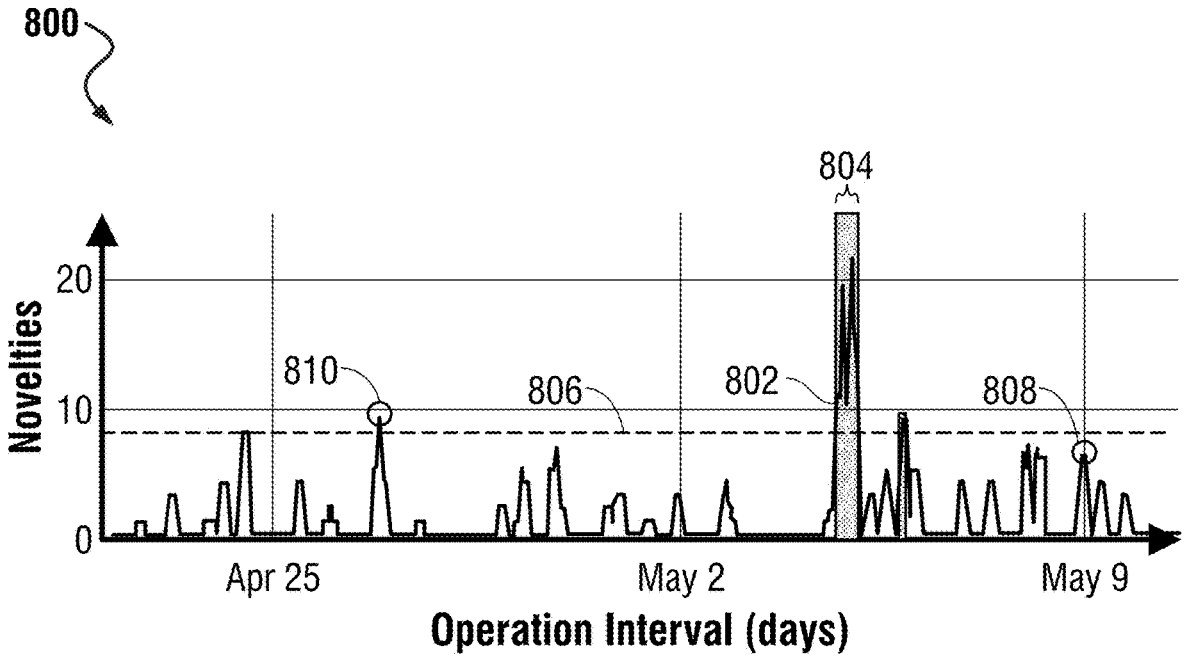
FIG. 8 illustrates an exemplary method of event detection for an event monitor and detector according to embodiments of the present disclosure.

FIG. 8 is a graph 800 showing an exemplary event threshold count that can be used by the event monitor and detector 138 (via event detector 326) to detect events according to embodiments of the present disclosure. In the graph 800, the vertical axis is a count of the novelties that have been detected and the horizontal axis indicates the time span (about 3 weeks) for the measurement data. Line 802 represents a count of novelties detected by the event monitor and detector 138 within a rolling detection window 804 (e.g., 4 hours) and line 806 represents an event threshold count for the event monitor and detector 138. The event monitor and detector 138 only records an "event" when the novelty count within the rolling window 804 (i.e., the rightmost portion thereof) is above the event threshold count 806. Thus, for example, the event monitor and detector 138 does not record an event for the novelty count indicated at 808, whereas the novelty count indicated 810 is recorded as an event.

In some embodiments, depending on the particular setup of the PCP 110 for the particular well site 100, the speed of the motor can change frequently during operation. Frequent motor speed change can cause the event monitor and detector 138 to frequently detect novelties and events that are false positives, thus requiring retraining of the ML models of the event monitor and detector 138 every time there is a new speed setting. To reduce the number of false positives, the data preprocessing module 322 (see FIG. 3) can be used to preprocess training data and live data in a specific way to reduce the sensitivity of the event monitor and detector 138 to frequent speed changes. This is explained with respect to FIG. 9.

Figure 9:
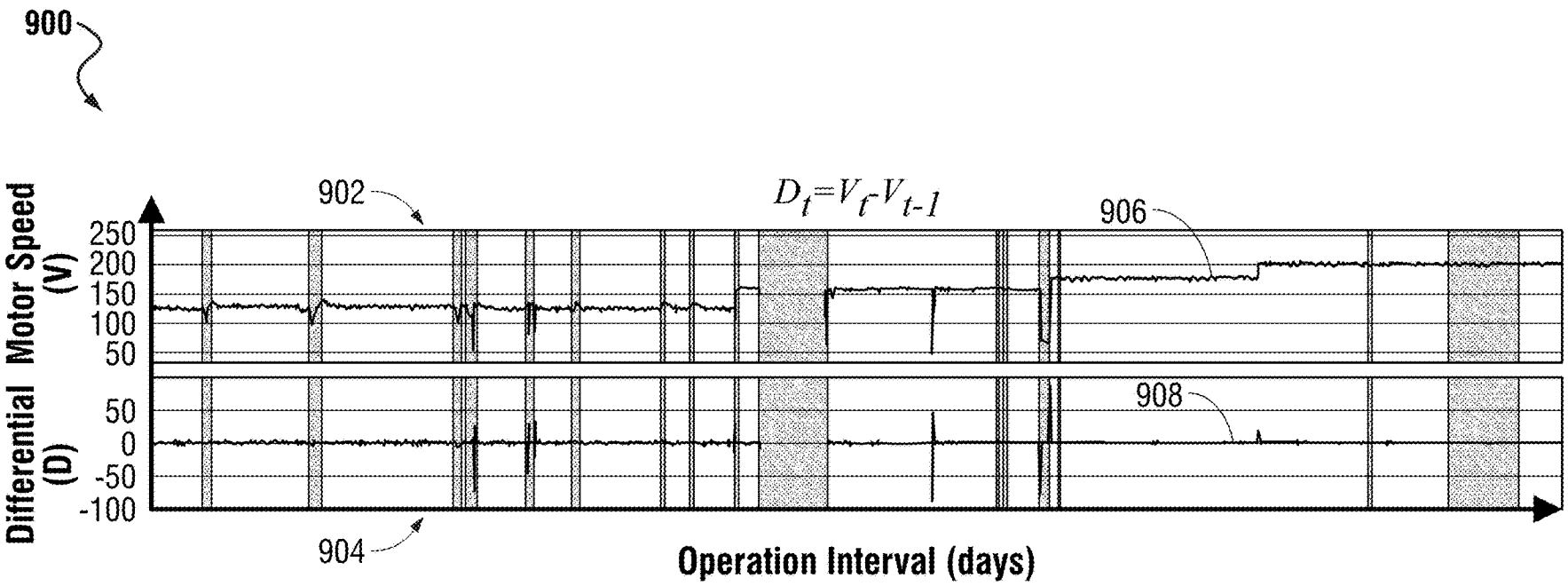
FIG. 9 illustrates an exemplary method of reducing sensitivity to speed changes for an event monitor and detector according to embodiments of the present disclosure.

Referring to FIG. 9, two graphs 902 and 904 are shown depicting motor speed. In the upper graph 902, the vertical axis represents actual motor speed as measured, for example, by the VSD controller 124*a*, while the horizontal axis is the operational interval over which the speed was measured (e.g., about 5 months). Line 906 tracks the measured motor speed (V). In the lower graph 904, the horizontal axis depicts differential motor speed, while the horizontal axis again is the operational interval over which the speed was measured. Line 908 tracks the differential speed (D). The relationship between the actual speed and the differential speed can be expressed as follows:

$$D_t = V_t - V_{t-1}$$

where t is a step in a time series. The differential speed, by definition, is a smaller value compared to the actual speed. By allowing the event monitor and detector 138 to compute and use differential speed values D instead of actual speed values V, the sensitivity of the event monitor and detector 138 to speed changes can be significantly reduced, thereby reducing the number of false positives.

Figure 10:
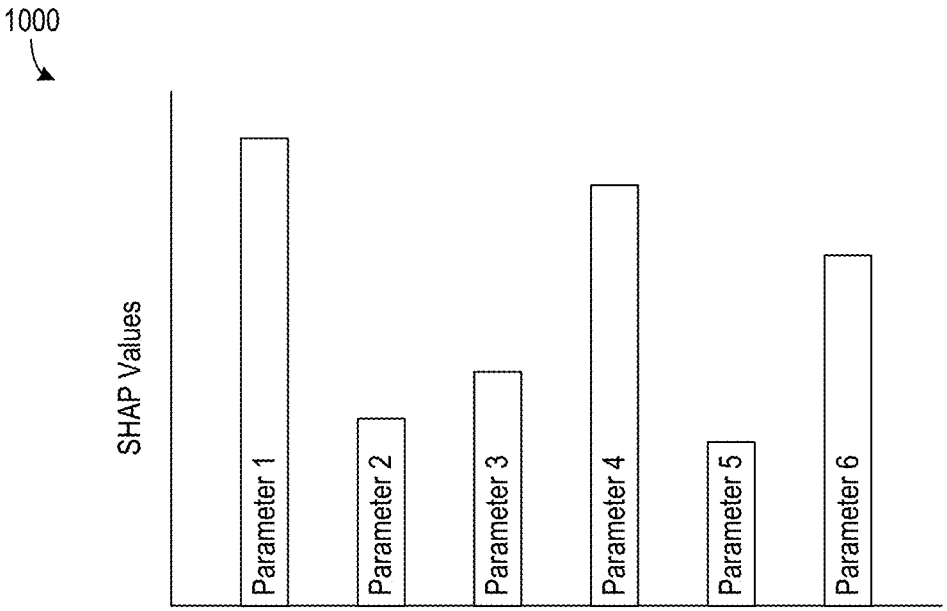
FIG. 10 illustrates an exemplary event explanation for an event monitor and detector according to embodiments of the present disclosure.

FIG. 10 is a bar chart 1000 showing an exemplary explanation that may be provided by the event monitor and detector 138 (via the event explainer module 328) in some embodiments. It will be recalled from FIG. 6 that for a given event, the event explainer module 328 uses SHAP values to provide an explanation that identifies the operational parameters contributing to the event and quantifies the degree to which each parameter contributed. The SHAP values are represented by the vertical axis in the chart 1000, while several operational parameters are shown as bars along the horizontal axis. Information making up the explanation can of course be provided in another format besides a bar chart, including as text only, depending on the particular application.

In FIG. 10, there are six parameters that were identified by the event explainer module 328 as contributing to the event: Parameter 1 (e.g., motor speed), Parameter 2 (e.g., motor load), Parameter 3 (e.g., pump efficiency), Parameter 4 (e.g., fluid flow rate), Parameter 5 (e.g., fluid level), and Parameter 6 (e.g., fluid pressure). Of the six parameters, Parameter 1 (e.g., motor speed) has the highest SHAP value as generated by the event explainer module 328. Thus, Parameter 1 (e.g., motor speed) contributed more heavily to occurrence of the event compared to the other five parameters. Well operators can then decide the best course of action to rectify the event, including no action, upon being presented with this explanation by the event monitor and detector 138. And as mentioned, the event monitor and detector 138 may also automatically take certain predefined steps to address the event, such as reducing motor speed, depending on the particular application.

Figure 11:
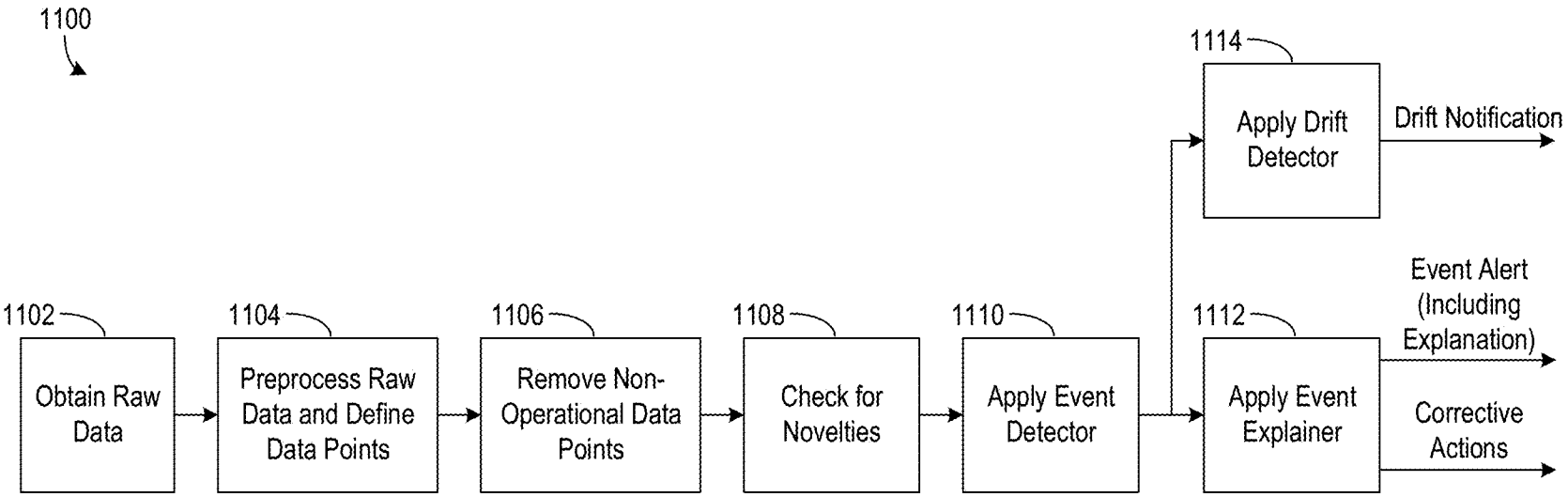
FIG. 11 illustrates an exemplary implementation of ML-based analytics to anticipate future failures at an edge device according to some embodiments.

Turning now to FIG. 11, a flow diagram 1100 illustrates an exemplary method that may be used by or with the event monitor and detector 138 to detect occurrence of an event in PCP operation according to embodiments of the present disclosure. The method generally begins at 1102 where the event monitor and detector 138 (via data preprocessing module 322) acquires or is used to acquire a set of raw measurement data pertaining to operation of the PCP to be monitored (e.g., PCP 110). The raw measurement data may be measurements of motor speed, motor load, pump efficiency, flow rate, fluid pressure, fluid level, temperature, and the like.

At 1104, the event monitor and detector 138 (via data preprocessing module 322) resamples or is used to resample the raw measurement data using a preselected time step, such as every 5 minutes. This preprocessing helps minimize the amount of duplicate or redundant data that has to be processed. During this step, each set of resampled data having the same timestamp will also be consolidated, combined, or otherwise converted to a single data point for further processing in the event monitor and detector 138.

At 1106, the event monitor and detector 138 (via data preprocessing module 322) removes or is used to remove any data points considered to be non-operational (i.e., data points where the motor speed is less than 20 rpm, for example). At 1108, the novelty detector module 324 determines or is used to determine whether there are any anomalies in the remaining data points. If yes, the event monitor and detector 138 (via novelty detector module 324) also determines whether any anomalies fall sufficiently far outside normal operating space (i.e., exceeds a threshold novelty score) to constitute a novelty.

At 1110, the event monitor and detector 138 (via event detector module 326) determines or is used to determine whether a sufficient number of novelties were detected within a predefined rolling detection window (e.g., 4 hours) to constitute an event. As mentioned previously, the event threshold count may be set to 9 in some embodiments, and can be fine-tuned as needed. The event monitor and detector 138 then issues an event alert to well operators, for example, via the SCADA system 134, the display 332, and/or an e-mail, text message, or other notification directly to the operators.

If an event is detected, then at 1112, the event monitor and detector 138 (via event explainer module 328) provides an explanation for the event. In some embodiments, the event monitor and detector 138 provides an explanation by generating SHAP values that indicate the parameters that contributed to the event and the degree to which each parameter contributed. The event monitor and detector 138 thereafter issues an event alert, including an explanation for the event. The event monitor and detector 138 may also automatically take certain predefined actions to minimize potential damage to the PCP resulting from the event in some embodiments.

At 1114, the event monitor and detector 138 (via drift detector module 330) determines or is used to determine whether there was a drift resulting from operator-initiated modifications or adjustments to the PCP. As discussed, the drift detection may be performed using any one or more, or all, of the previously described drift detection techniques. If the event monitor and detector 138 detects a drift, then it issues a drift notification containing drift information together with the event alert. Alternatively, in some embodiments, if the event monitor and detector 138 detects a drift, then it does not issue an alert for the event detected in conjunction with the drift. Instead, the event monitor and detector 138 issues a drift alert in lieu of an event alert to reduce the chances of reporting a false event.

In the preceding discussion, reference is made to various embodiments. However, the scope of the present disclosure is not limited to the specific described embodiments. Instead, any combination of the described features and elements, whether related to different embodiments or not, is contemplated to implement and practice contemplated embodiments. Furthermore, although embodiments may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The various embodiments disclosed herein may be implemented as a system, method or computer program product. Accordingly, aspects may take the form of an entirely hardware embodiment, an entirely software embodiment (including firmware, resident software, micro-code, etc.) or an embodiment combining software and hardware aspects that may all generally be referred to as a "circuit," "module" or "system." Furthermore, aspects may take the form of a computer program product embodied in one or more computer-readable medium(s) having computer-readable program code embodied thereon.

Any combination of one or more computer-readable medium(s) may be utilized. The computer-readable medium may be a non-transitory computer-readable medium. A non-transitory computer-readable medium may be, for example, but not limited to, an electronic, magnetic, optical, electromagnetic, infrared, or semiconductor system, apparatus, or device, or any suitable combination of the foregoing. More specific examples (a non-exhaustive list) of the non-transitory computer-readable medium can include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. Program code embodied on a computer-readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages. Moreover, such computer program code can execute using a single computer system or by multiple computer systems communicating with one another (e.g., using a private area network (PAN), local area network (LAN), wide area network (WAN), the Internet, etc.). While various features in the preceding are described with reference to flowchart illustrations and/or block diagrams, a person of ordinary skill in the art will understand that each block of the flowchart illustrations and/or block diagrams, as well as combinations of blocks in the flowchart illustrations and/or block diagrams, can be implemented by computer logic (e.g., computer program instructions, hardware logic, a combination of the two, etc.). Generally, computer program instructions may be provided to a processor(s) of a general-purpose computer, special-purpose computer, or other programmable data processing apparatus. Moreover, the execution of such computer program instructions using the processor(s) produces a machine that can carry out a function(s) or act(s) specified in the flowchart and/or block diagram block or blocks.

The flowchart and block diagrams in the Figures illustrate the architecture, functionality and/or operation of possible implementations of various embodiments of the present disclosure. In this regard, each block in the flowchart or block diagrams may represent a module, segment or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It is to be understood that the above description is intended to be illustrative, and not restrictive. Many other implementation examples are apparent upon reading and understanding the above description. Although the disclosure describes specific examples, it is recognized that the systems and methods of the disclosure are not limited to the examples described herein, but may be practiced with modifications within the scope of the appended claims. Accordingly, the specification and drawings are to be regarded in an illustrative sense rather than a restrictive sense. The scope of the disclosure should, therefore, be determined with reference to the appended claims, along with the full scope of equivalents to which such claims are entitled.

We claim:

1. A system for monitoring a progressing cavity pump (PCP) at a well site, comprising:

a processor; and a storage device coupled to the processor and storing computer-readable instructions for an event monitor and detector thereon;

wherein the event monitor and detector, when executed by the processor, causes the processor to:

sample data relating to operation of the PCP at the well site, the data representing parameters that affect PCP operation at the well site;

convert each set of sampled data to a data point, except for sampled data indicating that the PCP was non-operational;

compute a novelty score for each data point that falls outside a normal operating space for the PCP, the novelty score indicating a distance between the data point and the normal operating space;

obtain a count of data points where the novelty score exceeds a threshold novelty score within a rolling detection window; and initiate a responsive action in response to the count exceeding an event threshold count, the responsive action including at least one of: issuing an alert message to a control system notifying that an event has occurred, logging a date and time for the event, adjusting a motor speed of the PCP, or shutting off power to the PCP.

2. The system of claim 1, wherein the event monitor and detector further causes the processor to provide an explanation that identifies which parameters contributed to occurrence of the event and quantifies an extent to which the parameter contributed to the occurrence of the event.

3. The system of claim 2, wherein the explanation is provided using SHapley Additive explanations (SHAP) values.

4. The system of claim 1, wherein the event monitor and detector further causes the processor to detect whether drift has occurred in connection with the event and issue a drift notification in response to detecting that drift has occurred.

5. The system of claim 4, wherein the event monitor and detector causes the processor to detect whether drift has occurred by determining, for each parameter, whether a value for the parameter falls outside a preselected minimum and maximum value, whether the value for the parameter is within a preselected percentage of the preselected minimum and maximum value, or whether the value for the parameter exceeds a parameter novelty score.

6. The system of claim 1, wherein the parameters include motor speed and the event monitor and detector further causes the processor to use differential speed values for the motor speed, the differential speed values computed from measured speed values for the motor speed.

7. The system of claim 1, wherein the event monitor and detector is implemented on an edge device, or a portion of the event monitor and detector is implemented on the edge device and a portion of the event monitor and detector is implemented on a cloud computing environment.

8. A method of monitoring a progressing cavity pump (PCP) at a well site, comprising:

sampling, by an event monitor and detector, data relating to operation of the PCP at the well site, the data representing parameters that affect PCP operation at the well site;

converting, by the event monitor and detector, each set of sampled data to a data point, except for sampled data indicating that the PCP was non-operational;

computing, by the event monitor and detector, a novelty score for each data point that falls outside a normal operating space for the PCP, the novelty score indicating a distance between the data point and the normal operating space;

detecting, by the event monitor and detector, a count of data points where the novelty score exceeds a threshold novelty score within a rolling detection window;

initiating, by the event monitor and detector, a responsive action in response to the count exceeding an event threshold count, the responsive action including at least one of: issuing an alert message to a control system notifying that an event has occurred, logging a date and time for the event, adjusting a motor speed of the PCP, or shutting off power to the PCP.

9. The method of claim 8, further comprising providing, by the event monitor and detector, an explanation that identifies which parameters contributed to occurrence of the event and quantifies an extent to which the parameter contributed to the occurrence of the event.

10. The method of claim 9, wherein the explanation is provided using SHapley Additive explanations (SHAP) values.

11. The method of claim 8, further comprising detecting, by the event monitor and detector, whether drift has occurred in connection with the event and issuing a drift notification in response to detecting that drift has occurred.

12. The method of claim 11, wherein detecting whether drift has occurred is performed by determining, for each parameter, whether a value for the parameter falls outside a preselected minimum and maximum value, whether the value for the parameter is within a preselected percentage of the preselected minimum and maximum value, or whether the value for the parameter exceeds a parameter novelty score.

13. The method of claim 8, wherein the parameters include motor speed, further comprising using differential speed values for the motor speed, the differential speed values computed from measured speed values for the motor speed.

14. The method of claim 8, wherein the event monitor and detector is implemented on an edge device, or a portion of the event monitor and detector is implemented on the edge device and a portion of the event monitor and detector is implemented on a cloud computing environment.

15. A computer-readable medium comprising computer-readable instructions for causing a computer to:

sample data relating to operation of a PCP at a well site, the data representing parameters that affect PCP operation at the well site;

convert each set of sampled data to a data point, except for sampled data indicating that the PCP was non-operational;

compute a novelty score for each data point that falls outside a normal operating space for the PCP, the novelty score indicating a distance between the data point and the normal operating space;

obtain a count of data points where the novelty score exceeds a threshold novelty score within a rolling detection window;

initiate a responsive action in response to the count exceeding an event threshold count, the responsive action including at least one of: issuing an alert message to a control system notifying that an event has occurred, logging a date and time for the event, adjusting a motor speed of the PCP, or shutting off power to the PCP.

16. The computer-readable medium of claim 15, wherein the computer-readable instructions further cause the processor to provide an explanation that identifies which parameters contributed to occurrence of the event and quantifies an extent to which the parameter contributed to the occurrence of the event.

17. The computer-readable medium of claim 16, wherein the explanation is provided using SHapley Additive explanations (SHAP) values.

18. The computer-readable medium of claim 15, wherein the computer-readable instructions further cause the processor to detect whether drift has occurred in connection with the event and issue a drift notification in response to detecting that drift has occurred.

19. The computer-readable medium of claim 18, wherein the computer-readable instructions cause the processor to detect whether drift has occurred by determining, for each parameter, whether a value for the parameter falls outside a preselected minimum and maximum value, whether the value for the parameter is within a preselected percentage of the preselected minimum and maximum value, or whether the value for the parameter exceeds a parameter novelty score.

20. The computer-readable medium of claim 15, wherein the parameters include motor speed and the computer-readable instructions further cause the processor to use differential speed values for the motor speed, the differential speed values computed from measured speed values for the motor speed.

* * * * *